US011779806B1

(12) United States Patent
Morgan

(10) Patent No.: US 11,779,806 B1
(45) Date of Patent: Oct. 10, 2023

(54) EXERCISE MACHINE FOR EXERCISING WRIST AND FOREARM MUSCLES

(71) Applicant: Mark Anderson Morgan, Mobile, AL (US)

(72) Inventor: Mark Anderson Morgan, Mobile, AL (US)

( * ) Notice: Subject to any disclaimer, the term of this patent is extended or adjusted under 35 U.S.C. 154(b) by 0 days.

(21) Appl. No.: 17/384,380

(22) Filed: Jul. 23, 2021

(51) Int. Cl.

| | |
|---|---|
| ***A63B 23/14*** | (2006.01) |
| ***A63B 23/035*** | (2006.01) |
| ***A63B 21/062*** | (2006.01) |
| ***A63B 21/00*** | (2006.01) |

(52) U.S. Cl.
CPC ..... *A63B 23/14* (2013.01); *A63B 21/0628* (2015.10); *A63B 21/153* (2013.01); *A63B 21/154* (2013.01); *A63B 23/03525* (2013.01); *A63B 2225/093* (2013.01)

(58) Field of Classification Search
CPC ..... A63B 21/012; A63B 21/0407; A63B 21/0435; A63B 21/0442; A63B 21/015; A63B 21/062; A63B 21/0624; A63B 21/0626; A63B 21/0628; A63B 21/151; A63B 21/153; A63B 21/154; A63B 21/156; A63B 21/4023; A63B 1/00; A63B 3/00
See application file for complete search history.

(56) References Cited

U.S. PATENT DOCUMENTS

| | | | | |
|---|---|---|---|---|
| 4,072,308 | A * | 2/1978 | Applegate | A63B 23/14 482/904 |
| 4,311,305 | A * | 1/1982 | Lambert, Jr. | A63B 23/00 482/137 |
| 4,515,363 | A * | 5/1985 | Schleffendorf | A63B 23/03533 482/136 |
| 4,561,651 | A * | 12/1985 | Hole | A63B 21/06 482/102 |
| 4,811,944 | A * | 3/1989 | Hoff | A63B 23/129 482/905 |
| 5,037,087 | A * | 8/1991 | Roth | A63B 21/153 482/44 |
| 6,019,704 | A * | 2/2000 | Morgan | A63B 23/14 482/99 |
| 6,261,205 | B1 * | 7/2001 | Elefson | A63B 21/00181 482/135 |
| D476,706 | S * | 7/2003 | Albright | D21/684 |
| 6,592,498 | B1 * | 7/2003 | Trainor | A63B 21/0628 482/50 |
| 6,770,015 | B2 | 8/2004 | Simonson | |

(Continued)

*Primary Examiner* — Loan B Jimenez
*Assistant Examiner* — Zachary T Moore
(74) *Attorney, Agent, or Firm* — George L Williamson

(57) ABSTRACT

Method and apparatus for an improved exercise machine for specifically exercising the wrist and forearm muscles of a user. The exercise machine includes a rectangular shaped framework having left and right side vertical frame members along with upper and lower connecting cross members mounted on a pair of left and right support legs wherein a generally rectangular framework is formed. A rotatable vertically adjustable exercise bar is positioned forwardly on left and right U-shaped brackets so that the rotatable exercise bar is height adjustable using left and right vertical adjustments means. The forwardly extending rotatable exercise bar is disposed in a spaced away manner in front of the machine so as to be comfortably positioned for use by a user standing in front of the machine.

12 Claims, 2 Drawing Sheets

(56) References Cited

U.S. PATENT DOCUMENTS

| | | | | |
|---|---|---|---|---|
| 7,029,423 | B2 * | 4/2006 | Lear, Jr. | A63B 21/1627 482/40 |
| 7,112,162 | B2 | 9/2006 | Greenland | |
| 7,604,576 | B2 | 10/2009 | Drechsler | |
| 7,614,984 | B1 * | 11/2009 | Krull | A63B 23/03533 482/131 |
| 7,621,847 | B2 * | 11/2009 | Lamle | A63B 23/12 482/40 |
| 7,771,323 | B1 * | 8/2010 | Batca | A63B 21/4035 482/142 |
| 8,128,540 | B2 | 3/2012 | Savsek et al. | |
| 8,632,444 | B2 | 1/2014 | McBride | |
| 9,802,075 | B2 | 10/2017 | Gvoich | |
| 10,300,331 | B2 * | 5/2019 | Seltzer | A63B 23/03516 |
| 2003/0220174 | A1 * | 11/2003 | Lear, Jr. | A63B 21/1627 482/93 |
| 2006/0166797 | A1 * | 7/2006 | Hamer | A63B 21/4049 482/121 |
| 2006/0252609 | A1 * | 11/2006 | Abelbeck | A63B 21/0626 482/92 |
| 2007/0179030 | A1 * | 8/2007 | Slawinski | A63B 21/0724 482/99 |
| 2011/0098155 | A1 * | 4/2011 | Lemos | A63B 23/12 482/93 |
| 2013/0203558 | A1 * | 8/2013 | Lemos | A63B 21/154 482/93 |
| 2017/0282002 | A1 * | 10/2017 | Lee | A63B 23/03525 |
| 2018/0036573 | A1 * | 2/2018 | Lennox | A63B 21/00192 |
| 2018/0290006 | A1 | 10/2018 | Giannelli et al. | |
| 2019/0151702 | A1 * | 5/2019 | Grimes | A63B 21/0607 |

* cited by examiner

EXERCISE MACHINE FOR EXERCISING WRIST AND FOREARM MUSCLES

BACKGROUND OF THE INVENTION

Field of the Invention

The present invention relates generally to exercise and weight lifting equipment and, more particularly, is concerned with an exercise machine for specifically exercising the wrist and forearm muscles.

Description of the Related Art

Devices relevant to the present invention have been described in the related art; however, none of the related art devices disclose the unique features of the present invention.

In U.S. Pat. No. 6,019,704 dated Feb. 1, 2000, Morgan disclosed an exercise machine to exercise the wrist and forearm muscles. In U.S. Pat. No. 8,128,540 dated Mar. 6, 2012, Savsek, et al., disclosed a multipurpose exercise system. In U.S. patent application Publication Ser. No. 018/0290006, dated Oct. 11, 2018, Giannelli, et al., disclosed an adaptive resistance exerting exercise apparatus. In U.S. Pat. No. 6,770,015 dated Aug. 3, 2004, Simonson disclosed an exercise apparatus with sliding pulley. In U.S. Pat. No. 7,112,162 dated Sep. 26, 2006, Greenland disclosed an exercise machine. In U.S. Pat. No. 9,802,075 dated Oct. 31, 2017, Gvoich, disclosed a dual balanced exercise apparatus. In U.S. Pat. No. 7,604,576 dated Oct. 20, 2009, Drechsler disclosed a uniquely multifunctional exercise device. In U.S. Pat. No. 8,632,444 dated Jan. 21, 2014, McBride, et al., disclosed a portable workout apparatus having a pivotally mounted exercise bar.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an improved exercise machine for specifically exercising the wrist and forearm muscles of a user. The exercise machine includes a framework having left and right side vertical frame members along with upper and lower connecting cross members mounted on a pair of left and right support legs wherein a generally rectangular framework is formed. A rotatable vertically adjustable exercise bar is positioned forwardly on left and right U-shaped brackets so that the rotatable exercise bar is height adjustable using left and right vertical adjustments means. The forwardly extending rotatable exercise bar is disposed in front and spaced away from the machine so as to be comfortably positioned for use by a user standing in front of the machine. The present invention also includes an adjustable weight stack connected to the rotatable exercise bar by means of a flexible strap that allows the user to adjust the amount of weight tensioned on his wrist and forearm muscles.

An object of the present invention is to provide an exercise machine for specifically exercising the wrist and forearm muscles of a user. A further object of the present invention is to provide an exercise machine that does not stress the muscles of the user other than the wrist and forearm muscles. A further object of the present invention is to provide an exercise machine that is height adjustable so that it can be used by users of various heights. A further object of the present invention is to provide an exercise machine that can be easily operated by a user. A further object of the present invention is to provide an exercise machine that can be relatively easily and inexpensive manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
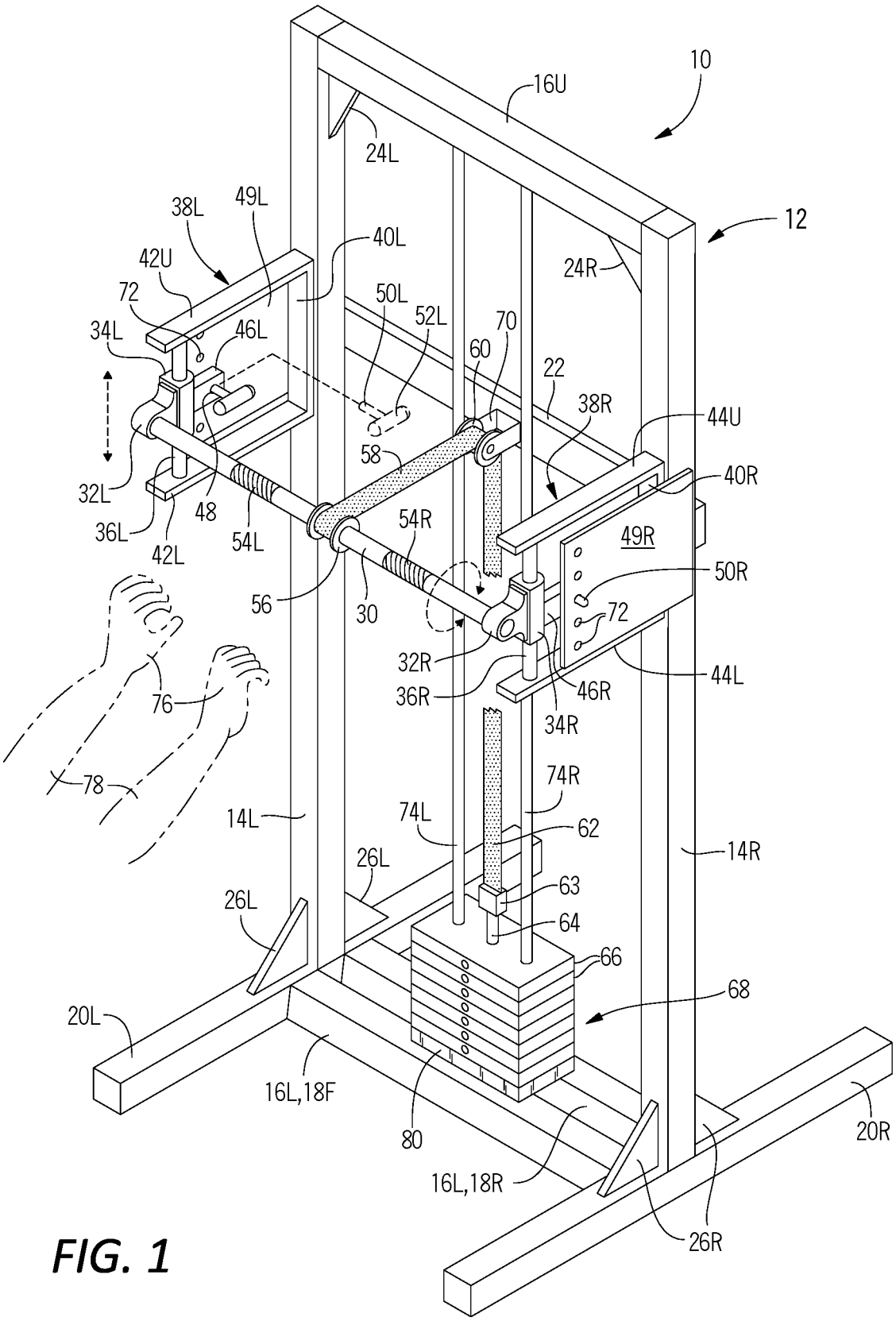
FIG. 1 is a front perspective view of the present invention.

With regard to reference numerals used, the following numbering is used throughout the drawings.

10 present invention
12 framework
14L left vertical side frame member
14R right vertical side frame member
16U upper cross member
16L lower cross member
18F front lower cross member
18R rear lower cross member
20L left base support leg
20R right base support leg
22 intermediate cross member
24L left upper corner gusset
24R right upper corner gusset
26L left front/rear corner gusset
28R right front/rear corner gusset
30 rotatable exercise bar
32L left bearing housing
32R right bearing housing
34L left collar
34R right collar
36L left vertical height adjustment bar
36R right vertical height adjustment bar

38L left U-shaped bracket
38R right U-shaped bracket
40L left base of U-shaped bracket
40E right base of U-shaped bracket
42U left upper forwardly extending arm of U-shaped bracket
42L left lower forwardly extending arm of U-shaped bracket
44U right upper forwardly extending arm of U-shaped bracket
44L right lower forwardly extending arm of U-shaped bracket
46L left rearwardly extending arm
46R right rearwardly extending arm
48 aperture
49L left height adjustment side plate
49R right height adjustment side plate
50L left adjustment pin
50R right adjustment pin
52L left adjustment handle
52R right adjustment handle
54L Left knurled area
54R right knurled area
56 spool
58 upper end of flexible strap/cable
60 pulley
62 lower end of flexible strap
63 connecting means/weight stack connector
64 weight pin rod
66 weight plates
68 weight stack
70 U-shaped bracket
72 spaced apertures
74L left weight guide bar
74R right weight guide bar
76 hands
78 forearm
80 flat plate for support
82 slot
84 connector
86 connector pin

DETAILED DESCRIPTION OF THE PREFERRED EMBODIMENT

Figure 2:
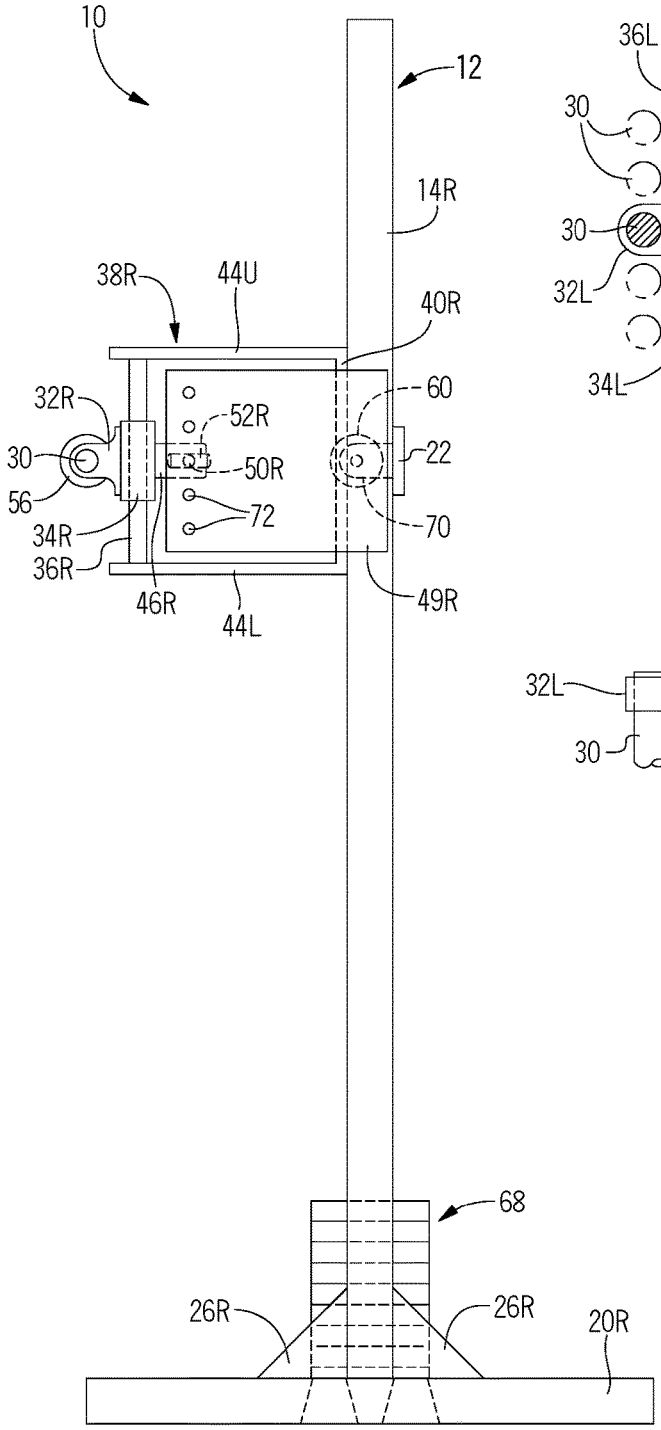
FIG. 2 is a right side elevation view of the present invention.
Figure 3:
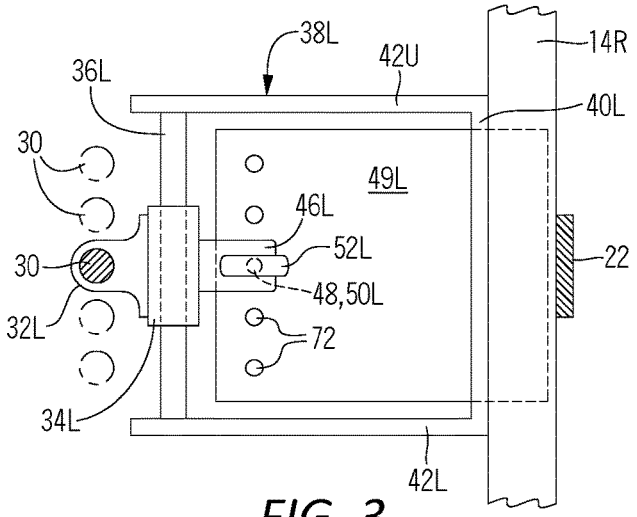
FIG. 3 is a right side elevation view of the left side height adjustment assembly of the present invention.
Figure 4:
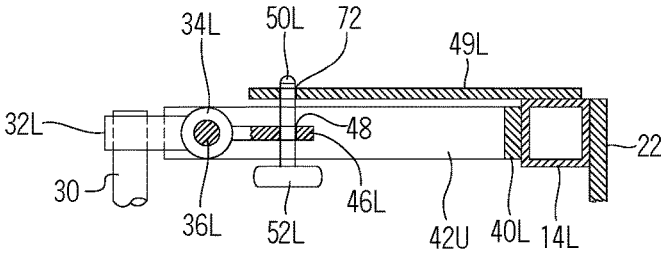
FIG. 4 is a plan view of the left side height adjustment assembly of the present invention.
Figure 5:
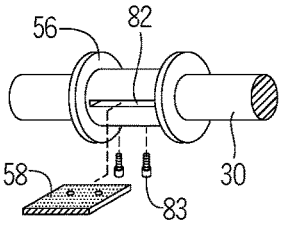
FIG. 5 is an enlarged perspective view of portions of the present invention.
Figure 6:
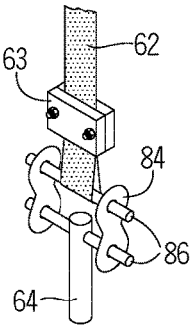
FIG. 6 is an enlarged perspective view of portions of the present invention.

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a height adjustable exercise machine for exercising the wrist and forearm muscles of a user is disclosed and which is generally indicated by reference number 10.

Turning to FIGS. 1 to 6, therein is shown the present invention 10 having a generally rectangularly shaped framework 12 comprising left and right vertical side frame members 14L, 14R, along with left and right upper and lower cross members, 16U, 16L which join at the upper and lower portions of the left and right vertical frame members 14L, 14R so that the left and right, side frame members are securely joined together. Note that the lower cross frame member 16L has a front member 18F and a rear member 18R upon which the weight stack 68 of the present invention 10 is disposed. Also shown are left and right support legs 20L, 20R which would be expected to rest on some type of supporting surface such as a ground surface, or a floor, being strong enough to support the weight of the present invention 10. An intermediate cross bar 22 is disclosed which joins the left and right vertical side frame members 14L, 14R so as to provide additional strength to the framework 12 along with providing a mounting surface for other components of the present invention 10. Framework 12 includes strengthening gussets 24L and 24R which are shown at the upper corners of the left and right vertical side frame members 14L, 14R and the upper cross member 16U. Also shown are a plurality of strengthening gussets 26L, 26R shown on the lower left front and rear of the left and right vertical side frame members 14L, 14R. Also shown is a generally horizontally disposed rotatable exercise bar 30 having a left end disposed in a left bearing housing 32L and a right end disposed in a right bearing housing 32R so that the rotatable exercise bar can be freely rotated by using the hands 76 of the user as he exercises his wrist and forearm 78 muscles. Bearing housings 32L, 32R could be referred to as pillow bearings also. The left and right bearing housings 32L and 32R are each mounted on a left and right collars 34L, 34R which are vertically slidable using linear bearings on corresponding left and right vertical height adjustment bars 36L, 36R so that the rotatable exercise bar 30 is height adjustable on the present invention 10 to accommodate users of various heights. The left and right vertical height adjustment bars 36L, 36R each disposed on upper and lower members of a forwardly extending U-shaped brackets 38L, 38R wherein each U-shaped bracket has a base 40L, 40R which are securely joined to a front face of a corresponding left and right vertical side frame member 14L, 14R so that the U-shaped brackets 38L, 38R securely held in place. Each of the left and right U-shaped brackets 38L, 38R have upper and lower forwardly extending arms 42U, 42L and 44U, 44L so that the left vertical height adjustment bar 36L is joined to the left forwardly extending arms 42U, 42L and the right vertical height adjustment bar 36R is joined to the right upper and lower forwardly extending arm 44U, 44L.

Each collar 34L, 3R4 has a corresponding rearwardly extending arm 46L, 46R having an aperture 48 therein which is proximate left and right height adjustment side plates 49L, 49R which are attached to an outer surface of each left and right vertical side frame member 14L and 14R. A left and right adjustment pin 50L, 50R is disposed slidably in each aperture 48 so that the left and right adjustment pins can be easily removed and replaced in the aperture 48 using a left and right adjustment handle or tee handle 52L, 52R which allows the rotatable exercise bar 30 to be easily vertically height adjustable by simply removing the left and right adjustment pins 50L, 50R and sliding the collars 34L, 34R up or down the left and right vertical height adjustment bar 36L, 36R. A plurality of vertically spaced apart apertures 72 are disposed in left and right adjustable side plates 49L, 49R which each have the rear end secured to an outer surface of a corresponding left and right vertical side members 14L, 14R in such a way that the height adjustment side plates 49L, 49R spaced away from the left and right U-shaped brackets 38L, 38R. The rotatable exercise bar 30 also has left and right knurled areas 54L, 54R which areas are useful for the user to grasp the rotatable exercise bar 30 in his hand so that the rotatable exercise bar can be easily rotated as he exercises his wrist and forearm muscles.

The rotatable exercise bar 30 is also equipped with a centrally disposed spool 56 having slot 82 therein (see FIG. 5) for holding a first end of a flexible strap/cable 58 using retaining screws 83 as an intermediate portion of the strap passes over another pulley 60 disposed on the front side of cross member 22 so that the strap has a lower end with connecting means 63 for connection using an 8-shaped member 84 (see FIG. 6) and pins 86 to a weight pin rod 64 passing through a central aperture of a plurality of weight plates 66 which together form a weight stack 68 placed on a flat plate 80 for support and for providing the weight to provide resistance through the strap 58 to the rotatable exercise bar 30 so that a user can exercise his wrist and forearm muscles. It can be seen that the weight stack 68 is supported underneath by flat plate 80 and on the front and rear lower cross members 18F, 18R and that the weight stack 68 is slidable upwardly and downwardly on left and right weight guide bars 74L, 74R extending from the upper to lower cross member 16U, 16L. It can also be seen that the pulley 60 is mounted in a U-shaped bracket 70 disposed on a front surface of the intermediate cross member 22.

In operation, it can be seen that a user can adjust the height of the rotatable exercise bar 30 by merely grasping the left and right adjustment handles 52L, 52R in his hands 76 to remove the left and right adjustment pins 50L, 50R from the plurality of spaced adjustment apertures 72 and then manually moving the rotatable exercise bar 30 upwardly or downwardly with the user selecting the appropriate aperture within which to insert the right and left adjustment pins 50L, 50R so as to accommodate the height of the user. The rotatable exercise bar 30 is expected to be about 5 to 10 inches vertically adjustable so as to accommodate a wide range of users, however, the distance could be greater depending on the size chosen for the components of the height adjustment assembly.

Pertinent dimensions of the present invention 10 follow: the present invention 10 is about 6' tall; bar 30 is about 24" wide and about 14" in front of cross member 22; spaced apertures 72 are about 2" apart vertically with the middle hole being about 56" from the floor/supporting surface; bearings 32L, 32R are about 1" bearings, flat plate 80 is about 4"×8" and about ¼" thick; base support legs 20L, 20R are spaced apart about 2' horizontally; framework 12 may be as large as 2"×4" rectangular tubing; and weight guide bars 74L, 74R are about 2" in diameter or 2"×2" rectangular tubing.

Left and right side designations regarding the present invention 10 are interpreted from the view of a user standing in front of the present invention 10 in position to use the present invention 10 while looking from the front to the rear of the present invention 10.

I claim:

1. An exercise machine for exercising wrists and forearms of a user, comprising:

a) a framework having upper and lower cross members and left and right vertical side frame members, wherein said framework is generally rectangularly shaped;

b) left and right U-shaped brackets disposed on a front of corresponding said left and right vertical side frame members;

c) a rotatable rod for being grasped by a hand of the user, wherein said rotatable rod is disposed on said left and right U-shaped brackets, wherein said rotatable rod is vertically adjustable in height;

d) a spool disposed on said rotatable rod;

e) a pulley rotatably attached to said framework; and f) an elongated flexible strap having a first end attached to said spool, an intermediate portion passing over said pulley, and a second end attached to a weight stack supported on said lower cross members;

g) wherein a base of each said left and right U-shaped bracket is disposed on the front of corresponding said left and right vertical side frame members; and h) left and right upper and lower forwardly extending arms of said left and right U-shaped brackets and left and right vertical height adjustment bars disposed on a corresponding said left and right upper and lower forwardly extending arms to permit said rotatable rod to be vertically adjustable in height.

2. The exercise machine of claim 1, wherein one of each end of said rotatable rod is vertically movably disposed on a corresponding said left and right vertical height adjustment bars.

3. The exercise machine of claim 2, further comprising left and right collars being vertically slidably disposed on corresponding said left and right vertical height adjustment bars.

4. The exercise machine of claim 3, further comprising left and right rearwardly extending arms disposed on corresponding said left and right collars, each said left and right rearwardly extending arms having an aperture therein, each said aperture for receiving an adjustment pin of an adjustment handle.

5. The exercise machine of claim 4, further comprising left and right height adjustment side plates disposed on said framework each having vertically aligned holes therein, wherein said adjustment pins engage one of said vertically aligned holes to permit said rotatable rod is to be adjustable to a user selected height.

6. The exercise machine of claim 5, further comprising left and right bearing housings disposed on corresponding said left and right collars, each said bearing housing for receiving said end of said rotatable rod to permit said rotatable rod to rotate therein.

7. A method for exercising wrists and forearms of a user, comprising the steps of:

a) providing a framework having upper and lower cross members and left and right vertical side frame members, wherein the framework is generally rectangularly shaped;

b) providing left and right U-shaped brackets on a front of corresponding left and right vertical side frame members;

c) providing a rotatable rod for being grasped by a hand of the user, wherein the rotatable rod is disposed on the left and right U-shaped brackets, wherein the rotatable rod is vertically adjustable in height;

d) providing a spool on the rotatable rod;

e) providing a rotatable pulley on the framework; and f) providing an elongated flexible strap having a first end attached to the spool, an intermediate portion passing over the pulley, and a second end attached to a weight stack supported on the lower cross members;

g) wherein a base of each left and right U-shaped bracket is disposed on the front of corresponding left and right vertical side frame members; and h) providing left and right upper and lower forwardly extending arms of the left and right U-shaped brackets and left and right vertical height adjustment bars disposed on a corresponding said left and right upper and lower forwardly extending arms to permit the rotatable rod to be vertically adjustable in height.

8. The method of claim 7, wherein one of each end of the rotatable rod is vertically movably disposed on a corresponding left and right vertical height adjustment bars.

9. The method of claim 8, further comprising the step of providing left and right collars being vertically slidably disposed on corresponding left and right vertical height adjustment bars.

10. The method of claim 9, further comprising the step of providing left and right rearwardly extending arms disposed on corresponding left and right collars, each left and right rearwardly extending arm having an aperture therein, each aperture for receiving an adjustment pin of an adjustment handle.

11. The method of claim 10, further comprising the step of providing left and right height adjustment side plates disposed on the framework each having vertically aligned holes therein, wherein the adjustment pins engage one of the vertically aligned holes to permit the rotatable rod to be adjustable to a user selected height.

12. The method of claim 11, further comprising the step of providing left and right bearing housings disposed on corresponding left and right collars, each bearing housing for receiving said end of the rotatable rod to permit the rotatable rod to rotate therein.

* * * * *